US006941799B2

(12) United States Patent
McCabe

(10) Patent No.: US 6,941,799 B2
(45) Date of Patent: Sep. 13, 2005

(54) REAL-TIME CONTROL SYSTEM AND METHOD OF USING SAME

(75) Inventor: Thomas McCabe, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/689,273

(22) Filed: Oct. 20, 2003

(65) Prior Publication Data

US 2005/0081611 A1 Apr. 21, 2005

(51) Int. Cl.[7] ..... G01M 15/00
(52) U.S. Cl. ..... 73/117.3
(58) Field of Search ..... 73/116, 117.2, 73/117.3, 118.1

(56) References Cited

U.S. PATENT DOCUMENTS

| | | | | | |
|---|---|---|---|---|---|
| 5,002,023 | A | | 3/1991 | Butterfield et al. | 123/90.15 |
| 5,107,804 | A | | 4/1992 | Becker et al. | 123/90.17 |
| 5,172,659 | A | | 12/1992 | Butterfield et al. | 123/90.17 |
| 5,184,578 | A | | 2/1993 | Quinn, Jr. et al. | 123/90.17 |
| 5,289,805 | A | | 3/1994 | Quinn, Jr. et al. | 123/90.17 |
| 5,361,735 | A | | 11/1994 | Butterfield et al. | 123/90.17 |
| 5,497,738 | A | | 3/1996 | Siemon et al. | 123/90.17 |
| 5,505,079 | A | * | 4/1996 | Rossignol | 73/117.3 |
| 5,611,304 | A | | 3/1997 | Shinojima | 123/90.15 |
| 5,657,725 | A | | 8/1997 | Butterfield et al. | 123/90.17 |
| 5,906,652 | A | * | 5/1999 | Remboski et al. | 701/110 |
| 6,101,993 | A | | 8/2000 | Lewis et al. | 123/90.17 |
| 6,247,434 | B1 | | 6/2001 | Simpson et al. | 123/90.17 |
| 6,250,265 | B1 | | 6/2001 | Simpson | 123/90.17 |
| 6,263,846 | B1 | | 7/2001 | Simpson et al. | 123/90.17 |
| 6,311,655 | B1 | | 11/2001 | Simpson et al. | 123/90.17 |
| 6,374,787 | B2 | | 4/2002 | Simpson et al. | 123/90.17 |
| 6,477,999 | B1 | | 11/2002 | Markley | 123/90.17 |

FOREIGN PATENT DOCUMENTS

| | | | |
|---|---|---|---|
| JP | 60062400 | 3/1985 | G05D/13/00 |
| JP | 62165199 | 7/1987 | G05B/13/00 |
| JP | 63148102 | 6/1988 | G01B/7/30 |
| JP | 02199220 | 8/1990 | |
| JP | 05155583 | 6/1993 | F02D/13/02 |
| JP | 11334575 | 12/1999 | B60T/13/66 |
| JP | 2001214353 | 8/2001 | D04B/27/26 |

* cited by examiner

*Primary Examiner*—Eric S. McCall
(74) *Attorney, Agent, or Firm*—Brown & Michaels, PC; Greg Dziegielewski

(57) ABSTRACT

A real-time control system having a fixed loop time is provided. The system includes an input having frequency ranging both above and below the fixed loop time; and a method for utilizing information provided by a pulse wheel and sensed by a sensor. The method includes the steps of: providing a rotating shaft; providing a pulse wheel rigidly affixed onto the rotating shaft; providing a sensor sensing an information out of the pulse wheel, the sensed information comprising a first information and a second information; and when the rotating rate of the rotating shaft is greater than a predetermined value, averaging at least two pulses wherein one of the at least two pulses being related to the first information and at least one pulse being related to the second information; thereby, the second information is used along with the first information for a more accurate representation of the information.

17 Claims, 6 Drawing Sheets

REAL-TIME CONTROL SYSTEM AND METHOD OF USING SAME

FIELD OF THE INVENTION

The invention pertains to the field of variable cam timing (VCT) phase measurement. More particularly, the invention pertains to phase averaging at high rotational speeds.

BACKGROUND OF THE INVENTION

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

Consideration of information disclosed by the following U.S. patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control method suitable for computer implementation that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes a camshaft has a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposed end in response to a signal from an engine control unit. The vane can be biased to an extreme position to provide a counteractive force to a unidirectionally acting frictional torque experienced by the camshaft during rotation.

U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,250,265 shows a variable valve timing system with actuator locking for internal combustion engine. The system comprising a variable camshaft timing system comprising a camshaft with a vane secured to the camshaft for rotation with the camshaft but not for oscillation with respect to the camshaft. The vane has a circumferentially extending plurality of lobes projecting radially outwardly therefrom and is surrounded by an annular housing that has a corresponding plurality of recesses each of which receives one of the lobes and has a circumferential extent greater than the circumferential extent of the lobe received therein to permit oscillation of the housing relative to the vane and the camshaft while the housing rotates with the camshaft and the vane. Oscillation of the housing relative to the vane and the camshaft is actuated by pressurized engine oil in each of the recesses on opposed sides of the lobe therein, the oil pressure in such recess being preferably derived in part from a torque pulse in the camshaft as it rotates during its operation. An annular locking plate is positioned coaxially with the camshaft and the annular housing and is moveable relative to the annular housing along a longitudinal central axis of the camshaft between a first position, where the locking plate engages the annular housing to prevent its circumferential movement relative to the vane and a second position where circumferential movement of the annular housing relative to the vane is permitted. The locking plate is biased by a spring toward its first position and is urged away from its first position toward its second position by engine oil pressure, to which it is exposed by a passage leading through the camshaft, when engine oil pressure is sufficiently high to overcome the spring biasing force, which is the only time when it is desired to change the relative positions of the annular housing and the vane. The movement of the locking plate is controlled by an engine electronic control unit either through a closed loop control system or an open loop control system.

U.S. Pat. No. 6,263,846 shows a control valve strategy for vane-type variable camshaft timing system. The strategy involves an internal combustion engine that includes a camshaft and hub secured to the camshaft for rotation therewith, where a housing circumscribes the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes to define circumferentially alternating advance and retard chambers. A configuration for controlling the oscillation of the housing relative to the hub includes an electronic engine control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft is discribed. A housing circumscribes the rotor, is rotatable with both the rotor and the camshaft, and is further oscillatable with respect to both the rotor and the camshaft between a fully retarded position and a fully advanced position. A locking configuration prevents relative motion between the rotor and the housing, and is mounted within either the rotor or the housing, and is respectively and releasably engageable with the other of either the rotor and the housing in the fully retarded position, the fully advanced position, and in positions therebetween. The locking device includes a locking piston having keys terminating one end thereof, and serrations mounted opposite the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,477,999 shows a camshaft that has a vane secured to an end thereof for non-oscillating rotation therewith. The camshaft also carries a sprocket that can rotate with the camshaft but is oscillatable with respect to the camshaft. The vane has opposed lobes that are received in opposed recesses, respectively, of the sprocket. The recesses have greater circumferential extent than the lobes to permit the vane and sprocket to oscillate with respect to one another. The camshaft phase tends to change in reaction to pulses that it experiences during its normal operation, and it is permitted to change only in a given direction, either to advance or retard, by selectively blocking or permitting the flow of pressurized hydraulic fluid, preferably engine oil, from the recesses by controlling the position of a spool within a valve body of a control valve. The sprocket has a passage extending therethrough the passage extending parallel to and being spaced from a longitudinal axis of rotation of the camshaft. A pin is slidable within the passage and is resiliently urged by a spring to a position where a free end of the pin projects beyond the passage. The vane carries a plate with a pocket, which is aligned with the passage in a predetermined sprocket to camshaft orientation. The pocket receives hydraulic fluid, and when the fluid pressure is at its normal operating level, there will be sufficient pressure within the pocket to keep the free end of the pin from entering the pocket. At low levels of hydraulic pressure, however, the free end of the pin will enter the pocket and latch the camshaft and the sprocket together in a predetermined orientation.

U. S. patent application Ser. No. 10/405,513 entitled "Compensating for VCT Error Over Speed Ranges", describes a method for compensating for variable cam timing of an internal combustion engine. The method includes: a) providing a periodical crank pulse signal (62); b) providing a periodical cam pulse signal (66); c) determining a segment, wherein the internal combustion engine speed induces a volatile change upon Zphase values (90); d) dividing the segment into sub-segments; and e) calculating Zphase values (90) of a plurality of points within the sub-segments.

In a VCT system, for a fixed number of teeth sensor wheel, an engine controller may miss some of the sensed information due to the fact that the sensor wheel spins faster than the engine controller's sampling rate. If the previous condition occurs, some of the sensed information is lost or not used by the engine controller such as an engine control unit (ECU).

Therefore, in a fixed time control system or fixed time loop relating to an ECU, it is desirous to have a method or system such that when a controller relating to a VCT system having pulse wheel for measurement purposes misses some of the sensed or measured information, the method or system can still use the missed information.

SUMMARY OF THE INVENTION

A real-time control system having a fixed loop time is provided. The system includes an input having frequency ranging both above and below the fixed loop time; and a method for utilizing information provided by a pulse wheel and sensed by a sensor.

A method for measuring a VCT system by using pulse wheels taking account of the cam torsional is provided. One of the pulse wheels is mounted on the crankshaft and the other(s) on the camshaft(s).

A method for measuring a VCT system by using pulse wheels taking account of the cam torsional is provided. In the VCT system, the pulse wheel may produce phase angle information much faster than the electronic controller such as an ECU can use the same.

At high engine speeds, extra information provided by the pulse wheel sensor system to the controller is utilized. The formerly unused information is now used in that it is a contributing element for averaging with the formally used information.

Accordingly, a real-time control system having a fixed loop time is provided. The system includes an input having frequency ranging both above and below the fixed loop time; and a method for utilizing information provided by a pulse wheel and sensed by a sensor. The method includes the steps of: providing a rotating shaft; providing a pulse wheel rigidly affixed onto the rotating shaft; providing a sensor sensing an information out of the pulse wheel, the sensed information comprising a first information and a second information; and when the rotating rate of the rotating shaft is greater than a predetermined value, averaging at least two pulses wherein one of the at least two pulses being related to the first information and at least one pulse being related to the second information; thereby, the second information is used along with the first information for a more accurate representation of the information.

Accordingly, a method for utilizing information provided by a pulse wheel and sensed by a sensor is provided. The method includes the steps of: providing a rotating shaft; providing a pulse wheel rigidly affixed onto the rotating shaft; providing a sensor sensing an information out of the pulse wheel, the sensed information comprising a first information and a second information; providing a controller controlling or processing the sensed information out of the pulse wheel at a predetermined sampling rate; when the rotating rate of the rotating shaft is greater than a predetermined value, averaging at least two pulses wherein one of the at least two pulses being related to the first information and at least one pulse being related to the second information; thereby, the second information is used along with the first information for a more accurate representation of the information.

DESCRIPTION OF THE PREFERRED EMBODIMENT

In the present invention, the VCT system relating variable cam timing (VCT) phase measurement requires phase angle measurement between 2 shafts. The reference shaft is usually the crankshaft, and the measured shaft is usually the cam shaft; or one of the camshafts if there are more than one cam shaft. The method of measurement of the present invention is to use pulse wheels; one mounted on the crankshaft and the other(s) on the camshaft(s). As the shafts rotate, the pulse wheels excite sensors, which indicate to the electronic controller when the teeth on the pulse wheel have past the sensor. Through the measurement a method suitable for in a computer disclosed in U.S. Pat. No. 5,289,805, entitled SELF-CALIBRATING VARIABLE CAMSHAFT TIMING SYSTEM. As can be seen, the phase measurement of the patent as well as the present invention takes place using information contained in these measured pulses.

The camshafts on an engine have cam lobes which compress valve springs as it is turned. This periodic compression and release of the valve springs creates a turning force, or a torsional on the camshaft. This torsional force acts in directions of both the clockwise and counter clockwise as the camshaft spins.

The number of teeth on the pulse wheels that are used for measurement is determined by other system factors. In most cases, the rotational speed range of the engine leads to situations where the pulse wheel produces phase angle information much faster than the electronic controller can use it. For example, cam pulse wheels with 8 teeth per cam revolution give information every 10 ms at 1500 rpm. In this example, our controller runs its control loop at 10 ms. Below this speed, the controller is getting less than 1 update per loop, and thus, some loop executions are using old information. Above 1500 rpm, the controller is getting more than 1 update per revolution.

Figure 1:
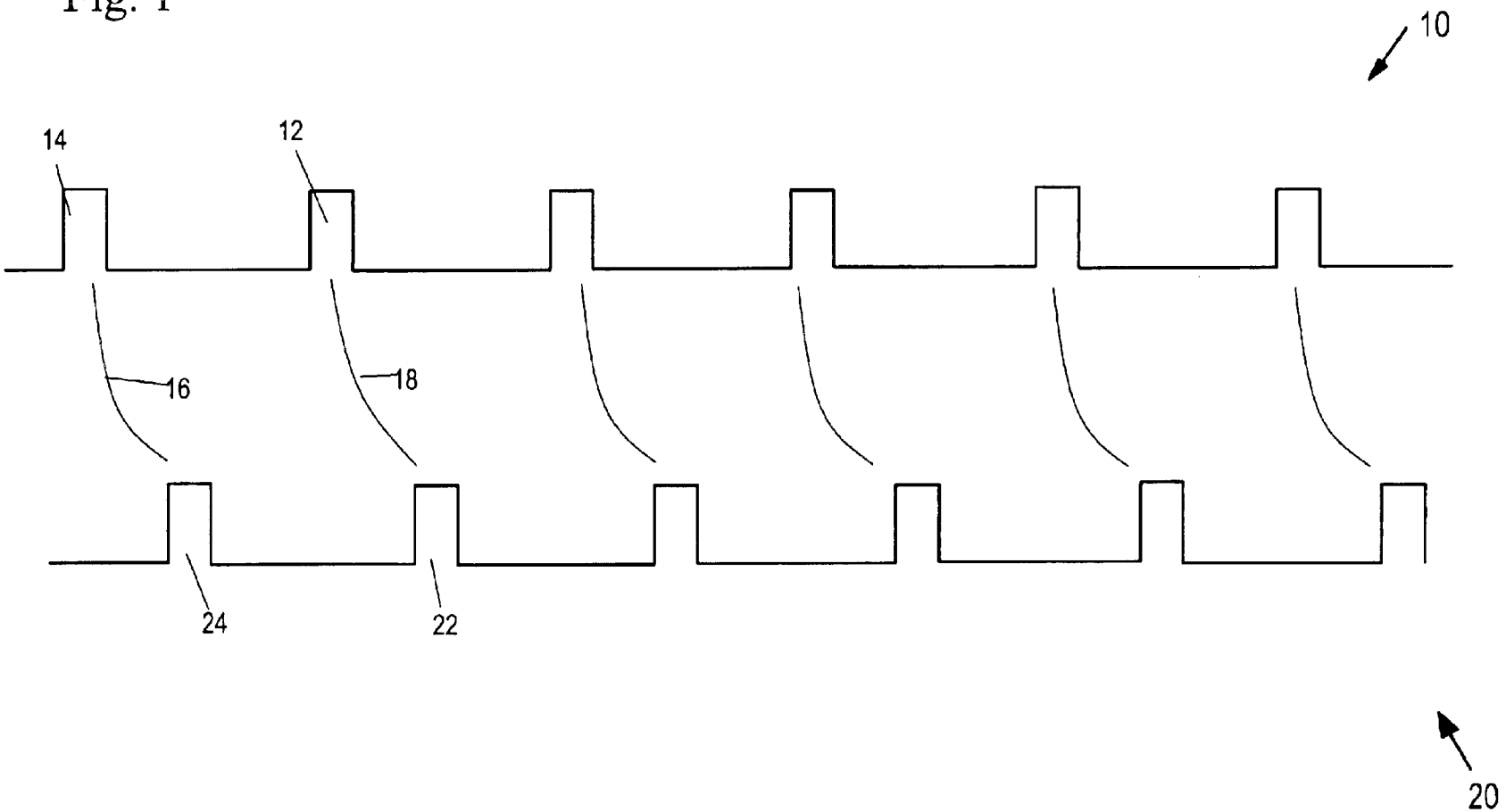
FIG. 1 shows a first scenario where pulse update rate is equal to loop execution rate.

Referring to FIG. 1, a scenario where pulse update rate is equal to loop execution rate is shown. A first sequence of sensed cam pulses 10 is provided. Pulses 20 denote a sequence of pre-arranged controller loop executions. As can be seen the pulse update rate is about the same as that of the loop execution rate. Therefore, each loop execution can use a corresponding sensed cam pulse which is the only pulse not used by the previous update. In other words, sensed cam pulse 12 is the only updated pulse used by controller loop execution pulse 22 and not used by the prior controller loop execution pulse 24. Execution pulse 24, also uses only a single update 14. The one on one relationship between pulses 12, 14 and pulses 22, 24 is indicated by indicators 16 and 18 respectively.

Figure 1A:
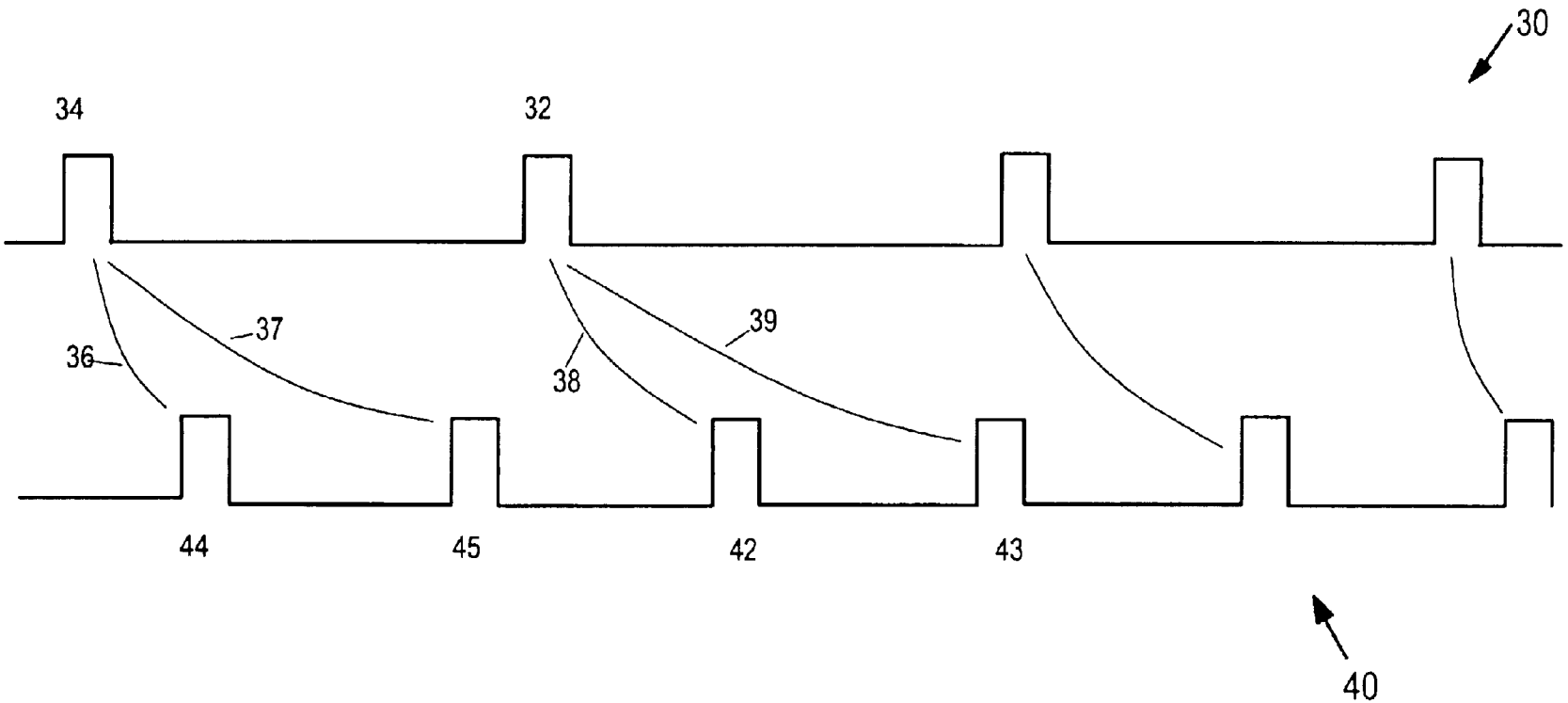
FIG. 1A shows a second scenario where pulse update rate is less than loop execution rate.

Referring to FIG. 1A, a second scenario where pulse update rate is less than loop execution rate is shown. A second sequence of sensed cain pulses 30 is provided. Pulses 40 denote a sequence of pre-arranged controller loop executions. As can be seen the pulse update rate is less than that of the loop execution rate. Therefore, sometimes each loop execution can use a sensed cam pulse more than once. In other words, sensed cam pulse 32 is an updated pulse that is used twice by controller loop execution 42 as the sensed pulse wheel signals are not updated as the second control loop 43 occurs. Therefore, both control loop 42 and 43 use the single sensed cam pulse 32. This scenario is indicated by indicators 38 and 39 respectively. Similarly, sensed cam pulse 34 is an updated pulse that is used twice by controller loop execution 44 as the sensed pulse wheel signals are not updated as the second control loop 45 occurs. This scenario is indicated by indicators 36 and 37 respectively. Typically, the second scenario occurs at low engine speeds.

Figure 1B:
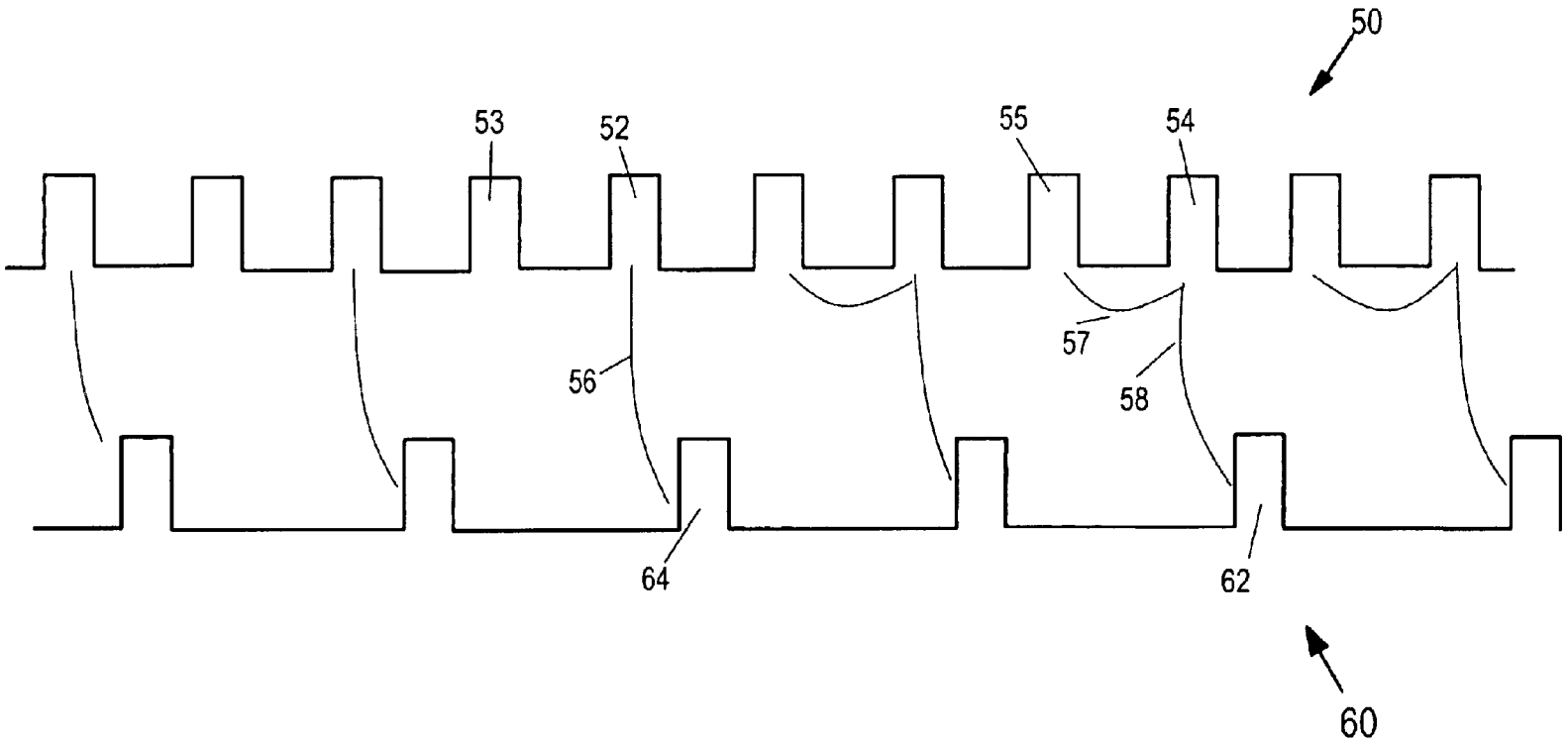
FIG. 1B shows a third scenario where pulse update rate is greater than loop execution rate.

Referring to FIG. 1B, a third scenario where pulse update rate is greater than loop execution rate is shown. A third sequence of sensed cam pulses 50 is provided. Pulses 60 denote a sequence of pre-arranged controller loop executions. As can be seen the pulse update rate is greater than that of the loop execution rate. Therefore, each loop execution can have the choice of two or more corresponding sensed cam pulses which are pulses not used by the previous update. In other words, each controller loop execution has the choice of using information contained in just one sensed pulse or using information contained in more than one sensed pulses.

Referring again to FIG. 1B, third sequence of sensed cam pulses 50 has some sensed pulses which are not used by control loops 60. As can be seen, sensed wheel pulse 52 is used by control loop execution 64. However, due to rate differences between third sequence of sensed cam pulses 50 and control loops 60, some pulses of the third sequence of sensed cam pulses 50 are not used. In other words, some of the sensed information contained in third sequence of sensed cam pulses 50 are lost to the controller if an one on one correspondence between third sequence of sensed cam pulses 50 and control loops 60 are set. As can be seen, for example, cam pulse 52 corresponds to control loop 64 and the prior loop to 64 corresponds to another pulse of third sequence of sensed cam pulses 50. Therefore, pulse 53 is left in-between and not used.

The present invention notes the un-used nature or state of pulses such as pulse 53 and devises a method or system such that information contained within the previously un-used pulses is used. Simply stated, the previously un-used pulse are averaged out with the used pulses, thereby information contained therein contribute to the overall information content. For detailed elements of the method and system, refer to other paragraphs herein this document.

By way of an example, Pulse 54 corresponds to control loop execution 62. If only pulse 54 is used, information contained within pulse 55 is lost to the controller. But by averaging information contained within both pulse 54 and pulse 55, information such as phase information in each pulse is taken into account. The relationship between pulse 52 and control loop 64 is shown by the relation line 56. Relation 56 does not take into account information constrained in pulse 53. On the other hand, according to the teachings of the present invention, the relationship between pulse 54, pulse 55, and control loop 62 is shown by the relation lines 57 and 58. Relations 57 and 58, in combination, take into account information constrained in both pulses 54 and 55. The third scenario typically occurs when the engine speed is high.

Referring back to the example, at 3000 rpm, the controller is receiving 2 updates per loop execution. However, the controller only uses the latter of the two, as it is the most recent information. At 4500 and 6000 rpm, in the same example, there are 3 and 4 updates per controller loop, respectively, where again only the last update is used.

As can be seen, the update rate at high engine speed is more than what the controller can use. One exception is that the pulse wheels have very low numbers of teeth on them. However, the number of teeth on a tooth wheel to be sensed is typically predetermined by relevant engine systems.

The present invention utilizes the extra information provided by the pulse wheel sensor system to the controller at high engine speeds. The formerly unused information is now used by the present invention in that it is a contributing element for averaging with the formally used ones. Thereby, the extra information is provided for a more accurate modeling of the system. Therefore, the controller make decisions based on the "whole" picture, rather then just the latest information. Moreover, the present invention teaches that by starting slightly before the threshold where there are 2 updates per loop, and averaging the last 2 pulse updates before the controller uses that information in the control loop. In our exemplified case, this threshold may be 3000 rpm where there are 2 updates per control loop, but preferably one wants to start averaging slightly before, at maybe 2800 rpm. The reason for starting to average before this threshold is that because the controller can potentially receiving more updates than required, but not exactly 2. Thus, the advantages of this averaging can be realized before this threshold. Also, we start averaging the last 3 pulse updates slightly before the 3 update/loop threshold, and the last 4 pulse updates before the 4 update/loop threshold, and so on.

Averaging the pulse updates over the entire speed range is not advantageous because at and below the 1 update/loop threshold, sudden changes in phase angle will be smoothed out by the averaging method. At low speeds, sudden changes in phase angle would not be recognized by the controller at full intensity immediately, and thus, the controller does not know the severity of the change, and cannot respond accurately. This happens at higher speed too, but since the controller would otherwise miss the extra information, so there is no degradation of performance, and in fact, the controller can receive more accurate information since it can use more available the information using the present invention.

It is noted that when averaging these signals at low speed (i.e. below the threshold where the cam pulse update rate is equal to the control loop execution rate) system performance level is reduced. This is because the updates occur less often than the control loop. the control loop is seeing information at least once, if not more. So, it is not practical to perform the averaging. On the other hand, at high speed, a severe cam phase change is typically "averaged out" by system and method of the present invention invention. However, the caveat is that since this theoretical abrupt change might be missed (because the control loop is missing updates), the fact that it might be "smoothed out" by the averaging doesn't matter. The end result is that the controller is using a more accurate representation of what is really happening.

The method of the present invention has been proved useful based on one exemplified configuration. By utilizing the same pulse wheel setup used above, i.e. 8 teeth per cam revolution, combined with 4 cam lobes per revolution makes for an aliasing effect at certain engine speeds. There are two associated torsionals for every cam lobe, one that works to retard cam timing, and one that works to advance cam timing. So, if there are 8 teeth on the pulse wheel, each tooth lines up with a torsional. Half are advancing torque, and the other half are retarding torque. These torsionals have the effect of oscillating the camshaft as it rotates, despite a ridged timing drive. At 3000 rpm, which in this example is the 2 updates/loop threshold, the controller is missing the first measurement, and using the second. However, with this unique case where there are cam torsionals that line up with the pulse wheel, the controller is seeing a phase angle measurement from only 1 cam torsional. This torsional causes oscillation either advancing or retarding, and the torsional that is missed is in the opposite direction. This means that for 2 teeth on the pulse wheel, there is one that measures the positive oscillation, and one that measures the negative. When the controller misses the first of 2 measurements, the controller cannot see the amplitude of the oscillation. What happens as a result of this is that the controller commands the lower or upper part of the phase oscillation to the setpoint.

Figure 2:
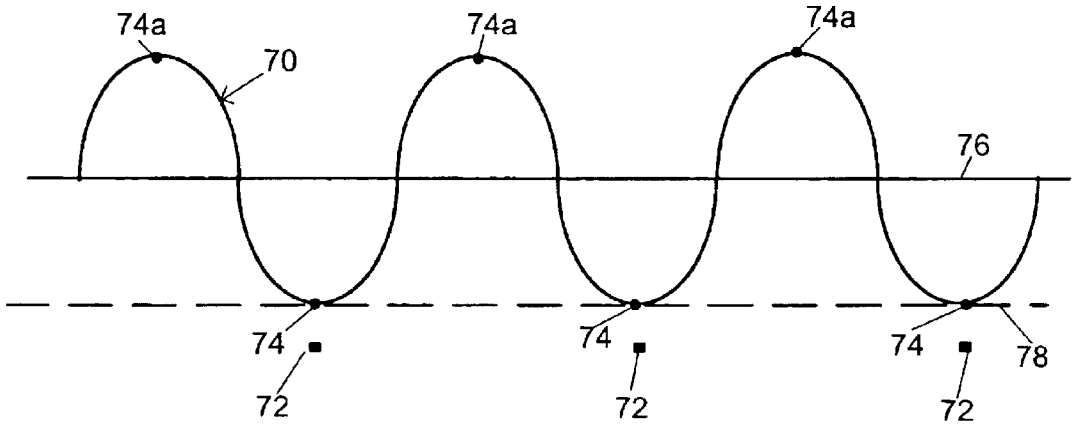
FIG. 2 shows a graph of torsional by cam at 3,000 rpm not using averaging.

Referring to FIG. 2, torsional by cam at 3,000 rpm not using averaging is shown. Graph 70 depicts the oscillation caused by cam torsionals. Squares 72 indicates loop execution events by the controller (not shown). Note that squares 72 indicates that the controller only samples the last dots 74 but not dots 74*a*. In other words, only the immediate previous or exact point in time is used. Since dot 74 and dot 74*a* both indicate sensed positioning information from the cam wheel, and the controller only samples at dot 74, update events from cam pulse wheel is biased. As can be seen, the real average phase position is line 76 if taking account of both loop execution events and all the cam update events. However, since only loop execution events in fed to or known by the controller, the calculated phase position is biased to broken line 78. In other words, only dots 74 are used by the controller. Dots 74*a* are not used.

As can be seen in FIG. 2, information is available at both top 74*a* and bottom 74 of oscillation curve, but since the controller does not "see" the information at the top 74*a*, it can only calculate 72 position with the bottom information 74.

Figure 3:
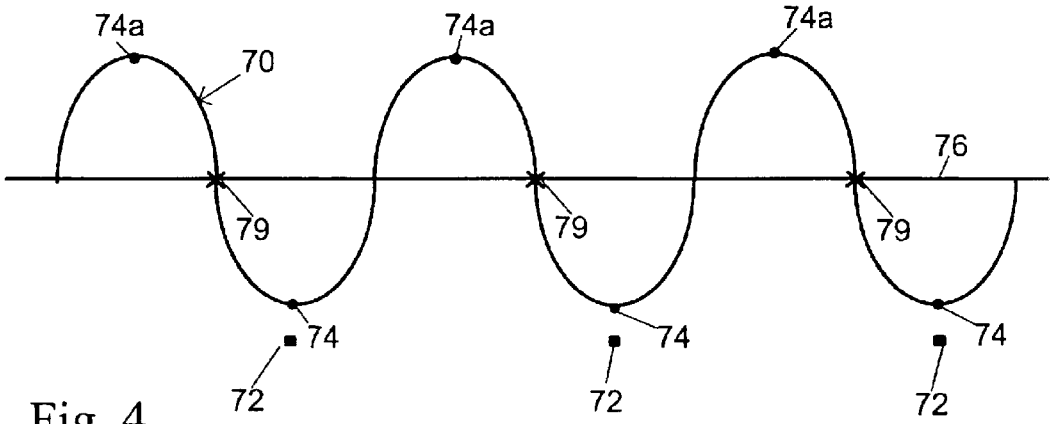
FIG. 3 shows the graph of torsional by cam at 3,000 rpm using averaging.

Referring to FIG. 3, torsionals exerted by cam at 3,000 rpm using averaging is shown. Graph 70 depicts the oscillation caused by cam torsionals. Squares 72 indicates loop execution events by the controller (not shown). Dot 74 indicates update events from cam pulse wheel. This time both point 74 and 74*a* are taken into account by the controller in that at sampling event 72 the average of both point 74 and 74*a* is at point 79. As can be seen, the real average phase position is line 76 taking account of both loop execution events and all the cam update events. Updated events 72 and 74 from cam pulse wheel are all taken into account and used, resulting in point 79 which is indicated by crosses. The average line 76 is formed by connecting all the dots 79 and is in the middle of the oscillation and accurately represents the real system in that the controller now "see" what is happening in the real, physical world. In other words, both dots 74 and Dots 74*a* are used by the controller. One way to use both dots 74 and 74*a* is by averaging the information contained within the two.

Figure 4:
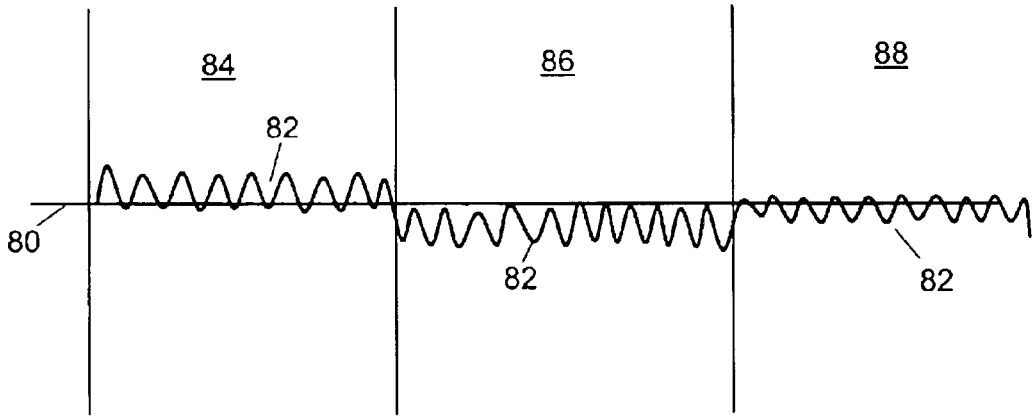
FIG. 4 shows a graph depicting the relationship between a set point and the actual phase angle.

Referring to FIG. 4, a graph depicting the relationship between a set point and the actual phase angle is shown. In the above example, when phase angle is measured with a high-precision phase angle measurement system, a steady-state phase offset to the setpoint by exactly 1 half of the oscillation magnitude is achieved. Line 80 is a setpoint, or requested cam position, related to the controller. Graph 82 spanning regions 84, 86, and 88 depicts actual phase measurements. As can be seen, in region 84 actual phase measurement reflects controlling to the bottoms of oscillation. This is performed without phase averaging aliasing effect. In region 86 actual phase measurement reflects controlling to the tops of oscillation. This is performed without phase averaging aliasing effect. In region 88 phase averaging method of the present is performed. Note the reduced oscillation and phase measurement that is centered on set point 80.

As can be seen, phase averaging can reduce actual oscillation. This is achieved by reducing the magnitude of the oscillation measured by the controller. In some cases, the controller will add oscillation to the system by trying to compensate for the oscillation that is measures. Phase averaging reduces this effect.

During most tests, it is not possible to hold emulated engine speed at exactly 3000 rpm. But when speed is off slightly, an aliasing effect is evident when switching from above the setpoint value to below, and vice-versa. At this speed condition, the phase averaging takes the latest two pulse updates representing the upper and lower peaks of the oscillation, and averages the peaks to indicate a phase angle in between the two. The controller is then able to recognize the mean phase to the setpoint, and this results in no steady-state offset or aliasing.

Figure 5:
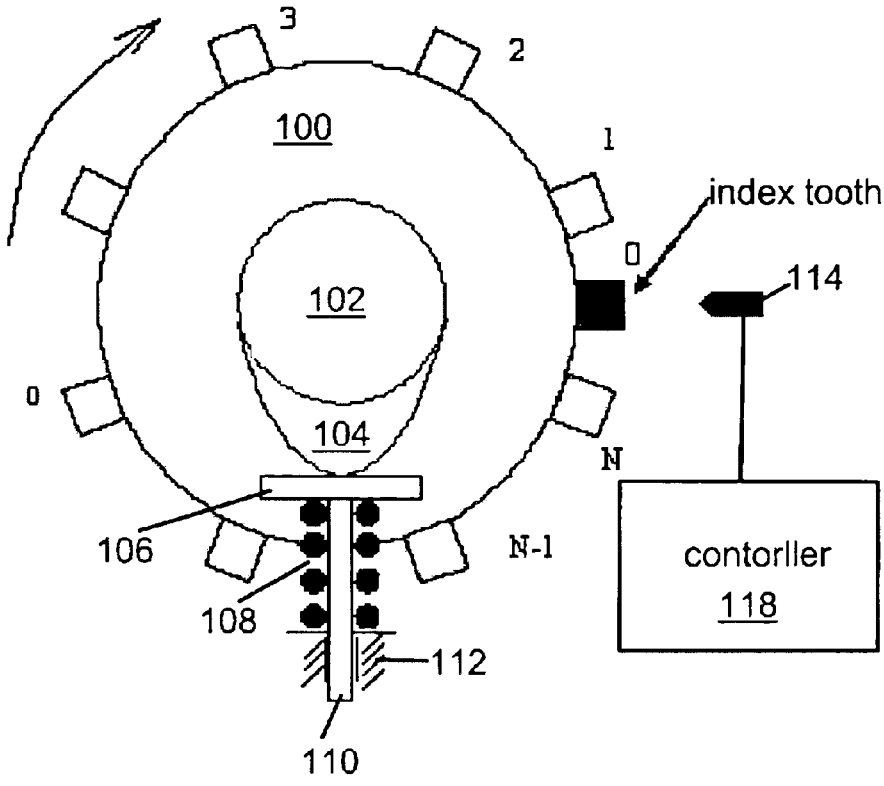
FIG. 5 shows a sensor wheel having nine (eight-plus-one) tooth and its installation on single-lobe camshaft.

Referring to FIG. 5, a nine (eight-plus-one) pulse-wheel 100 and its installation on single-lobe camshaft is shown. As can be seen a pulse wheel 100 having eight sympatric teeth and an index tooth is provided. An additional index tooth is used in order for a cam tooth sensor to sense the same as well as all the teeth. A controller (not shown) is used to record and process the sensed tooth information. It is noted that the all the teeth on the tooth wheel may evenly or symmetrically distributed. Or on the other hand the teeth may be asymmetrically distributed.

Tooth wheel 100 is mounted on a cam shaft 102 and rigidly affixed thereto and rotate along with the cam shaft 102. Cam shaft 102 has at least one cam lobe 104 which rotates in relation to a spring retainer 106 and exerting a force upon a surface of the spring retainer 106. A substantially equal counter force counter balances the force upon the surface by means of a valve spring 108 which is positioned upon a valve 110 in a known manner. Further, a valve guide 112 limits the movement of the valve in a known manner as well. A cam sensor 114 which is mounted stationarily in relation to the rotating tooth wheel 100 is provided for sensing the positions of the teeth on the wheel 100.

The camshaft 102 experiences positive torque during cylinder valves closing while the compressed valve springs 108 discharge their elastic kinetic energy. The zero crossing point of cam torque occurs when the angular position at which the tip of cam lobe contacts its driven part, such as the surface on the spring retainer 106. An index tooth is provided on the wheel 100 to an otherwise equally spaced tooth-wheel 100. As can be appreciated, an index pulse generated by the index tooth breaks the original uniform pulse distribution pattern. The controller is then able to identify each individual tooth on the tooth-wheel. However, as pointed out supra, other original pulse distribution may be non-uniform (not shown). Controller 118 is provided for controlling or processing information generated by the sensors 114.

Other shafts such as crank shaft can have similar layout in that a pulse wheel can be affixed onto a shaft and a sensor used for producing sensed information.

Figure 6:
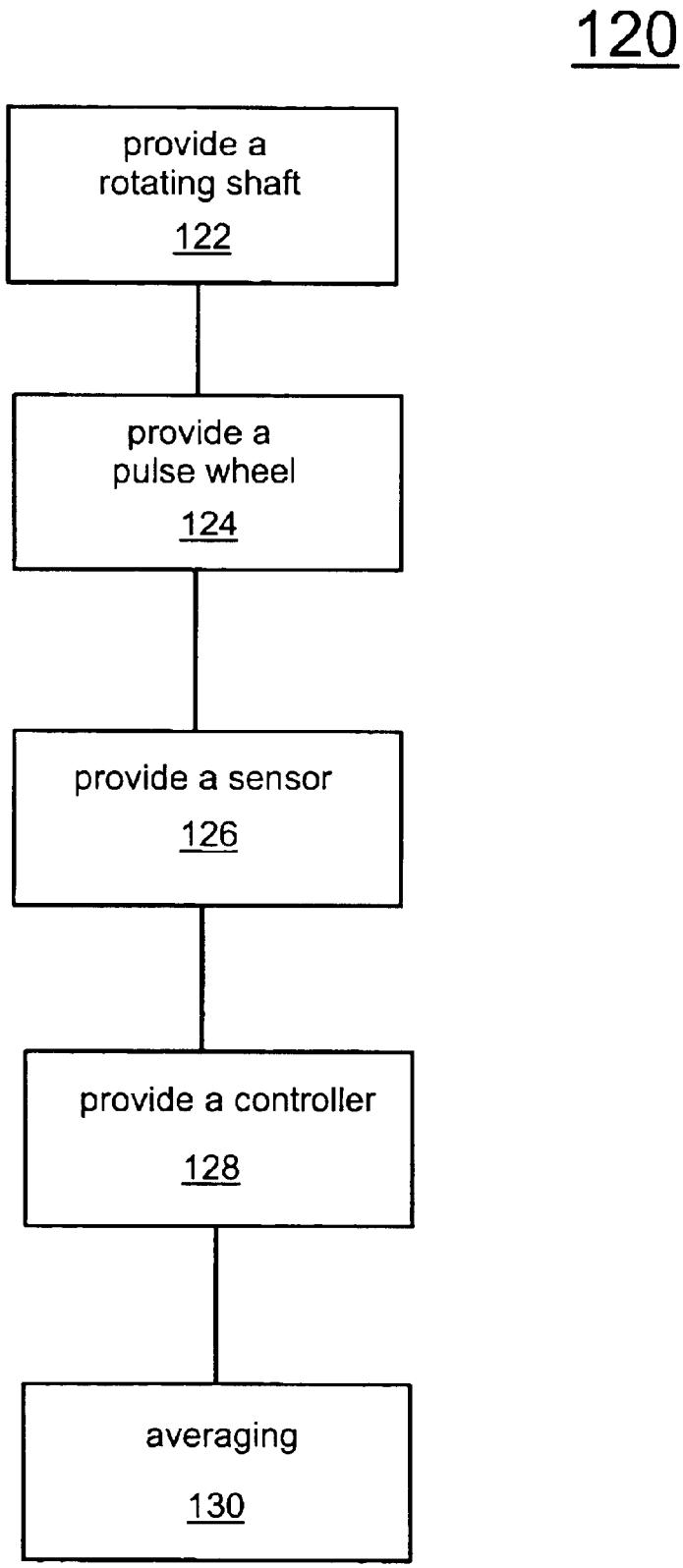
FIG. 6 shows a flow chart of the present invention.

Referring to FIG. 6, a flow chart 120 of the present invention is shown. A method for utilizing information provided by a pulse wheel and sensed by a sensor is provided. The method includes the steps of: providing a rotating shaft 122; providing a pulse wheel rigidly affixed onto the rotating shaft 124; providing a sensor sensing an information out of the pulse wheel 126. The sensed information comprises a first information and a second information. First information is related to information that can be sampled by the controller. The first information is the latest sensor information. Second information is related to information that is typically not sampled by the controller in prior art schemes. However, the present invention provides a method or system for using the second information by averaging among the first information and the second information. By way of an example, referring back to FIGS. 1–1B, first information is related to pulses 12, 14, 52, and 54. whereas second information is related to pulses 53 and 55.

The method further includes the steps of providing a controller for controlling or processing the sensed information out of the pulse wheel at a predetermined sampling rate 128; and when the rotating rate of the rotating shaft is greater than a predetermined value, averaging at least two pulses wherein one of the at least two pulses being related to the first information and at least one pulse being related to the second information 130; thereby, the second information is used along with the first information for a more accurate representation of the information.

One embodiment of the invention is implemented as a program product for use with a computer system such as, for example, the schematics shown in FIG. 5 and described below. The program(s) of the program product defines functions of the embodiments (including the methods described below with reference to FIG. 6 and can be contained on a variety of signal-bearing media. Illustrative signal-bearing media include, but are not limited to: (i) information permanently stored on in-circuit programmable devices like PROM, EPPOM, etc; (ii) information permanently stored on non-writable storage media (e.g., read-only memory devices within a computer such as CD-ROM disks readable by a CD-ROM drive); (iii) alterable information stored on writable storage media (e.g., floppy disks within a diskette drive or hard-disk drive); (iv) information conveyed to a computer by a communications medium, such as through a computer or telephone network, including wireless communications, or a vehicle controller of an automobile. Some embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, whether implemented as part of an operating system or a specific application, component, program, module, object, or sequence of instructions may be referred to herein as a "program". The computer program typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

Furthermore, the present invention can be used in almost any real-time control system where there is a fixed loop time, and the frequency of inputs into the system can vary from below the loop time, to above the loop time. In a generic sense, anytime that a control system responds to an input, by way of an interrupt, but does not use the information until the control loop starts again, can benefit from this concept.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA) VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Chamber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A real-time control system having a fixed loop time, comprising:

an input having a frequency ranging both above and below the fixed loop time;

a rotating shaft;

a pulse wheel rigidly affixed onto the rotating shaft; and a sensor sensing a plurality of information pulses out of the pulse wheel, wherein the information pulses comprise a first information pulse and a second information pulse;

wherein when a rotating rate of the rotating shaft is greater than a predetermined value, at least the first information pulse and the second information pulse are averaged such that the first information pulse and the second information pulse accurately represent the plurality of information pulses in a variable cam timing measurement system.

2. The method of claim 1, further comprising a controller, which processes the information pulses at a predetermined sampling rate, wherein the first information pulse comprises information relating to the pulse wheel, and the first information pulse provides the most recent information to be processed by the controller.

3. The system of claim 1, further comprising a controller, which processes the information pulses at a predetermined sampling rate, wherein the second information pulse comprises information relating to the pulse wheel, and the second information pulse provides information which is sequentially not the most recent information to be processed by the controller, but occurs prior in time to the most recent information.

4. The system of claim 1, wherein the first information pulse provides phase angle information sensed by the sensor out of the pulse wheel.

5. The system of claim 1, wherein the second information pulse provides phase angle information sensed by the sensor out of the pulse wheel.

6. The system of claim 1, wherein the rotating shaft is a cam-shaft of an internal combustion engine.

7. The system of claim 1, wherein the rotating shaft is a crank shaft of an internal combustion engine.

8. The system of claim 1, wherein the pulse wheel comprises a wheel having teeth distributed thereon.

9. A method for utilizing information provided by a pulse wheel and sensed by a sensor, comprising the steps of:

providing a rotating shaft;

providing a pulse wheel rigidly affixed onto the rotating shaft;

sensing a plurality of information pulses out of the pulse wheel, wherein the information pulses comprise a first information pulse and a second information pulse and a sensor senses the information pulses;

processing the information pulses out of the pulse wheel at a predetermined sampling rate, wherein a controller processes the information; and averaging at least the first information pulse and the second information pulse when a rotating rate of the rotating shaft is greater than a predetermined value such that the first information pulse and the second information pulse accurately represent the plurality of information pulses in a variable cam timing measurement system.

10. The method of claim 9, wherein the first information pulse comprises information relating to the pulse wheel, which is sequentially the most recent information to be processed by the controller.

11. The method of claim 9, wherein the second information pulse comprises information relating to the pulse wheel, which is sequentially not the most recent information to be processed by the controller, but occurs prior in time to the most recent information.

12. The method of claim 9, wherein the controller is an engine control unit.

13. The method of claim 9, wherein the first information pulse provides phase angle information sensed by the sensor out of the pulse wheel.

14. The method of claim 9, wherein the second information pulse provides phase angle information sensed by the sensor out of the pulse wheel.

15. The method of claim 9, wherein the rotating shaft is a cain-shaft of an internal combustion engine.

16. The method of claim 9, wherein the rotating shaft is a crank-shaft of an internal combustion engine.

17. The method of claim 9, wherein the pulse wheel comprises a wheel having teeth distributed thereon.

* * * * *

UNITED STATES PATENT AND TRADEMARK OFFICE

CERTIFICATE OF CORRECTION

PATENT NO. : 6,941,799 B2
DATED : September 13, 2005
INVENTOR(S) : McCabe et al.

It is certified that error appears in the above-identified patent and that said Letters Patent is hereby corrected as shown below:

Column 15,
Line 20, replace “cam-shaft” with -- camshaft --.

Column 16,
Line 28, replace “cain-shaft” with -- camshaft --.
Line 30, replace “crank-shaft” with -- crankshaft --.

Signed and Sealed this

Sixth Day of December, 2005

JON W. DUDAS
*Director of the United States Patent and Trademark Office*